US011384760B2

(12) United States Patent
Inoue et al.

(10) Patent No.: US 11,384,760 B2
(45) Date of Patent: Jul. 12, 2022

(54) ROTARY COMPRESSOR FOR ENHANCING EFFICIENCY AND SUPPRESSING VIBRATION

(71) Applicant: FUJITSU GENERAL LIMITED, Kanagawa (JP)

(72) Inventors: Akira Inoue, Kanagawa (JP); Kenshi Ueda, Kanagawa (JP); Shingo Yahaba, Kanagawa (JP); Yasuyuki Izumi, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 161 days.

(21) Appl. No.: 16/636,761

(22) PCT Filed: Jul. 25, 2018

(86) PCT No.: PCT/JP2018/027969

§ 371 (c)(1),
(2) Date: Feb. 5, 2020

(87) PCT Pub. No.: WO2019/039182

PCT Pub. Date: Feb. 28, 2019

(65) Prior Publication Data

US 2020/0166032 A1 May 28, 2020

(30) Foreign Application Priority Data

Aug. 24, 2017 (JP) ..... JP2017-161565

(51) Int. Cl.
*F04C 29/12* (2006.01)
*F04C 28/06* (2006.01)
(Continued)

(52) U.S. Cl.
CPC ..... *F04C 18/356* (2013.01); *F04C 27/00* (2013.01); *F04C 29/12* (2013.01);
(Continued)

(58) Field of Classification Search
CPC ..... F04C 18/356; F04C 27/00; F04C 29/12; F04C 18/324; F04C 29/128
See application file for complete search history.

(56) References Cited

U.S. PATENT DOCUMENTS 10,458,408 B2 * 10/2019 Morozumi ..... F04C 29/128
10,550,843 B2 * 2/2020 Tanaka ..... F04C 29/00
(Continued)

FOREIGN PATENT DOCUMENTS

CN 101532493 A 9/2009
CN 103032326 A 4/2013
(Continued)

OTHER PUBLICATIONS

English translation of JP-60150497 by J Piat Pat Jul. 21, 2021.*
Apr. 6, 2021, Chinese Office Action issued for related CN application No. 201880054262.2.

*Primary Examiner* — Deming Wan
(74) *Attorney, Agent, or Firm* — Paratus Law Group, PLLC

(57) ABSTRACT

A lower end plate includes: bolt holes through which bolts penetrate; a lower discharge valve; a lower discharge-valve accommodating recessed portion into which the lower discharge valve is accommodated; and a lower discharge-chamber recessed portion. A lower end plate cover is provided with a bulging portion. A lower end-plate cover chamber is formed by the lower discharge-valve accommodating recessed portion, the lower discharge-chamber recessed portion, and the bulging portion. Refrigerant passage holes include main refrigerant passage holes provided on the lower discharge-chamber recessed portion, and sub-refrigerant passage holes provided between the bolt hole and the lower discharge-valve accommodating recessed portion away from the lower discharge-valve accommodating recessed portion. The bulging portion is, in a cross section
(Continued)

orthogonal to a rotating shaft, formed so as to overlap with at least a part of each of the main refrigerant passage holes and the sub-refrigerant passage holes.

6 Claims, 5 Drawing Sheets

(51) Int. Cl.

| | |
|---|---|
| ***F04C 18/356*** | (2006.01) |
| ***F04C 18/324*** | (2006.01) |
| ***F04C 29/06*** | (2006.01) |
| ***F04C 27/00*** | (2006.01) |

(52) U.S. Cl.
CPC ..... *F04C 2240/30* (2013.01); *F04C 2240/50* (2013.01); *F04C 2240/60* (2013.01)

(56) References Cited

U.S. PATENT DOCUMENTS

| | | | |
|---|---|---|---|
| 2009/0180912 | A1 | 7/2009 | Morozumi et al. |
| 2010/0278675 | A1 | 11/2010 | Han et al. |
| 2013/0084202 | A1 | 4/2013 | Takahashi et al. |
| 2017/0335848 | A1 | 11/2017 | Morozumi et al. |

FOREIGN PATENT DOCUMENTS

| | | | | | |
|---|---|---|---|---|---|
| CN | 107002686 | A | | 8/2017 | |
| JP | 60150497 | A | * | 8/1985 | ..... F04C 29/128 |
| JP | H11-132177 | A | | 5/1999 | |
| JP | 2014-145316 | A | | 8/2014 | |
| JP | 2014-145318 | A | | 8/2014 | |
| JP | 2016-118142 | A | | 6/2016 | |
| WO | WO 2016/09871 | A1 | | 6/2016 | |

* cited by examiner (B-B)

(A-A)

ROTARY COMPRESSOR FOR ENHANCING EFFICIENCY AND SUPPRESSING VIBRATION

CROSS REFERENCE TO PRIOR APPLICATION

This application is a National Stage Patent Application of PCT International Patent Application No. PCT/JP2018/027969 (filed on Jul. 25, 2018) under 35 U.S.C. § 371, which claims priority to Japanese Patent Application No. 2017-161565 (filed on Aug. 24, 2017), which are all hereby incorporated by reference in their entirety.

FIELD

The present invention relates to a rotary compressor.

BACKGROUND

In an air conditioner and a refrigeration apparatus, for example, a two-cylinder rotary compressor is used for compressing a refrigerant. In the two-cylinder rotary compressor, in order to reduce fluctuation in torque per one rotation of a rotating shaft as much as possible, in general, two upper and lower cylinders are configured such that the processes of suction, compression, and discharge are performed in phases different by 180°. Except for peculiar operation conditions such as at the time of start-up, in the operation of the air conditioner at normal outdoor temperature and indoor temperature, the discharge process of one cylinder occupies approximately ⅓ in one rotation. Thus, ⅓ in one rotation is the discharge process (the process in which a discharge valve is opened) of one cylinder, another ⅓ is the discharge process of the other cylinder, and the remaining ⅓ is the process in which both discharge valves are closed.

When both of the two discharge valves of the upper cylinder and the lower cylinder are closed and there is no flow of refrigerant discharged from compression chambers, both an upper muffler chamber (hereinafter also referred to as an upper end-plate cover chamber) and a lower muffler chamber (hereinafter also referred to as a lower end-plate cover chamber) have the same pressure as that in a compressor housing that is the outside of the upper muffler chamber. In the discharge process of one of the cylinders, the pressure of the compression chamber that is the uppermost stream of the refrigerant flow is the highest in the compressed high-pressure area, and then the muffler chamber and the inside of the compressor housing, where is the outside of the upper muffler chamber, are high in this order. Accordingly, immediately after the discharge valve of the upper cylinder is opened, the pressure of the upper muffler chamber is higher than the pressure in the compressor housing outside of the upper muffler chamber and the pressure in the lower muffler chamber. Thus, at the next moment, the flow of refrigerant from the upper muffler chamber into the inside of compressor housing, where is the outside of the upper muffler chamber, and the flow of refrigerant from the upper muffler chamber to the lower muffle chamber by a backward flow through a refrigerant passage hole, arise. As just described, what is called a refrigerant backward flow phenomenon, in which a part of the refrigerant that is compressed to high pressure in the upper cylinder and is discharged to the upper muffler chamber flows backward through the refrigerant passage hole and flows into the lower muffler chamber, arises.

The flow from the upper muffler chamber into the inside of the compressor housing, where is the outside of the upper muffler chamber, is the original flow, but the refrigerant that has flowed from the upper muffler chamber to the lower muffler chamber flows into the inside of the compressor housing, where is the outside of the upper muffler chamber, through the refrigerant passage hole and the upper muffler chamber again, after finishing the discharge process of the upper cylinder. The flow into the compressor housing is a flow not needed originally, and that results in an energy loss and deteriorates the efficiency of the rotary compressor. Then, if the lower muffler chamber, which is formed to a lower end plate and a lower end-plate cover, is made too large, as space for which the refrigerant flows backward from the upper muffler chamber flows into the lower muffler chamber, becomes large, the deterioration in the efficiency of the rotary compressor tends to become large.

CITATION LIST

Patent Literature

Patent Literature 1: Japanese Laid-open Patent Publication No. 2016-118142

SUMMARY

Technical Problem

Hence, in order to reduce the deterioration in the efficiency of the rotary compressor, techniques to make the lower muffler chamber small and reduce the deterioration in the efficiency of the rotary compressor, by forming the lower end plate cover in a flat-plate shape, or by forming a bulging portion only on a part of the lower end plate cover, have been known.

However, when the volume of the bulging portion of the lower end plate cover is made too small, as the lower muffler chamber becomes too small, the refrigerant compressed in the lower compression chamber of the lower cylinder flows early from the lower muffler chamber to the upper muffler chamber through the refrigerant passage hole. Thus, there is a problem in that the pressure pulsation in the lower muffler chamber becomes large, a proper silencing effect by the lower muffler chamber is not obtainable, and the amplitude of vibration generated in the lower end-plate cover increases.

Meanwhile, when the volume of the bulging portion of the lower end plate cover is increased, the pressure pulsation in the lower muffler chamber is reduced, and the increase in the amplitude of vibration generated in the rotary compressor along with the pressure pulsation, is suppressed. However, in this case, as the space into which the refrigerant that has flowed backward from the upper muffler chamber through the refrigerant passage hole to the lower muffler chamber flows, is increased, it leads to the deterioration of the efficiency of the rotary compressor.

Based on the above, when an area where the bulging portion occupies in a cross section orthogonal to the shaft direction of the rotating shaft, is increased so that a proper volume is ensured in the volume of the bulging portion of the lower end plate cover for satisfying both the enhancement of the efficiency of the rotary compressor and the suppression of vibration of the rotary compressor, there has been a case where the refrigerant discharged into the lower muffler chamber may be not smoothly discharged from the refrigerant passage hole only by the refrigerant passage hole arranged in the vicinity of the lower discharge hole.

The disclosed technology has been made in view of the foregoing, and an object thereof is to provide a rotary compressor capable of enhancing the efficiency and suppressing the vibration.

Solution to Problem

To solve the above problem and attain the object, a rotary compressor disclosed in this application, according to an aspect, includes: a sealed and vertical cylindrical compressor housing provided with a refrigerant discharge portion at an upper portion and a refrigerant suction portion at a lower portion; a compression unit arranged at a lower portion of the compressor housing and configured to compress refrigerant that is sucked from the suction portion and to discharge the refrigerant from the discharge portion; and a motor arranged at an upper portion of the compressor housing and configured to drive the compression unit, wherein the compression unit includes: an annular upper cylinder and an annular lower cylinder, an upper end plate closing an upper side of the upper cylinder and a lower end plate closing a lower side of the lower cylinder, an intermediate partition plate arranged between the upper cylinder and the lower cylinder and closing a lower side of the upper cylinder and an upper side of the lower cylinder, a rotating shaft supported by a main bearing portion provided on the upper end plate and by a sub-bearing portion provided on the lower end plate, and rotated by the motor, an upper eccentric portion and a lower eccentric portion provided on the rotating shaft with a phase difference of 180° from each other, an upper piston fitted in the upper eccentric portion and configured to revolve along an inner peripheral surface of the upper cylinder and form an upper cylinder chamber in the upper cylinder, a lower piston fitted in the lower eccentric portion and configured to revolve along an inner peripheral surface of the lower cylinder and form a lower cylinder chamber in the lower cylinder, an upper vane projecting into the upper cylinder chamber from an upper vane groove provided on the upper cylinder and brought into contact with the upper piston so as to section the upper cylinder chamber into an upper suction chamber and an upper compression chamber, a lower vane projecting into the lower cylinder chamber from a lower vane groove provided on the lower cylinder and brought into contact with the lower piston so as to section the lower cylinder chamber into a lower suction chamber and a lower compression chamber, an upper end plate cover covering the upper end plate, forming an upper end-plate cover chamber between the upper end plate and the upper end plate cover, and having an upper end-plate cover discharge hole communicating with the upper end-plate cover chamber and an inside of the compressor housing, a lower end plate cover covering the lower end plate and forming a lower end-plate cover chamber between the lower end plate and the lower end plate cover, an upper discharge hole provided on the upper end plate and communicating with the upper compression chamber and the upper end-plate cover chamber, a lower discharge hole provided on the lower end plate and communicating with the lower compression chamber and the lower end-plate cover chamber, and a plurality of refrigerant passage holes running through the lower end plate, the lower cylinder, the intermediate partition plate, the upper end plate, and the upper cylinder and communicating with the lower end-plate cover chamber and the upper end-plate cover chamber, the lower end plate includes: a plurality of bolt holes that is provided along a circumferential direction of the lower end plate and through which bolts that couple the compression unit penetrate, a lower discharge valve of a reed valve type that is configured to open and close the lower discharge hole, a lower discharge-valve accommodating recessed portion that extends in a groove shape up to a portion between the bolt holes adjacent in the circumferential direction from the lower discharge hole and into which the lower discharge valve is accommodated, and a lower discharge-chamber recessed portion formed so as to overlap with the lower discharge hole side of the lower discharge-valve accommodating recessed portion, the lower end plate cover is formed in a flat-plate shape and is provided with a bulging portion having a portion facing the lower discharge hole, the lower end-plate cover chamber is formed by the lower discharge-valve accommodating recessed portion, the lower discharge-chamber recessed portion, and the bulging portion, the refrigerant passage holes include a main refrigerant passage hole provided on the lower discharge-chamber recessed portion, and a sub-refrigerant passage hole provided between the bolt hole and the lower discharge-valve accommodating recessed portion away from the lower discharge-valve accommodating recessed portion, and the bulging portion is, in a cross section orthogonal to the rotating shaft, formed so as to overlap with at least a part of each of the main refrigerant passage hole and the sub-refrigerant passage hole.

Advantageous Effects of Invention

According to one aspect of the rotary compressor disclosed in the present application, it is possible to enhance the efficiency of the rotary compressor and to suppress the vibration.

DESCRIPTION OF EMBODIMENT

The following describes in detail an exemplary embodiment of a rotary compressor disclosed in the present application with reference to the accompanying drawings. The rotary compressor disclosed in the present application is not limited by the following exemplary embodiment.

Embodiment

Configuration of Rotary Compressor

Figure 1:
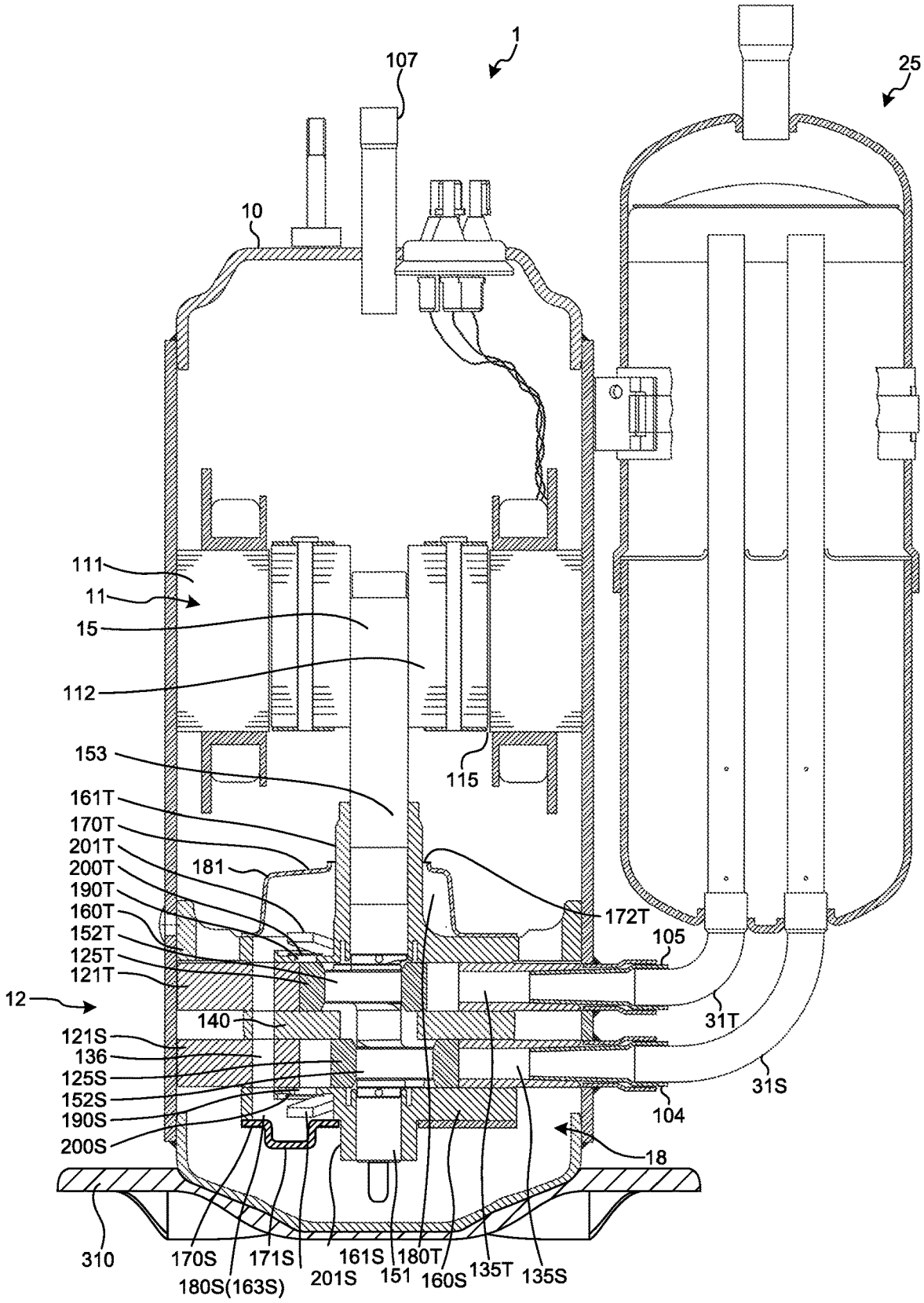
FIG. 1 is a longitudinal sectional view illustrating a rotary compressor of an embodiment.
Figure 2:
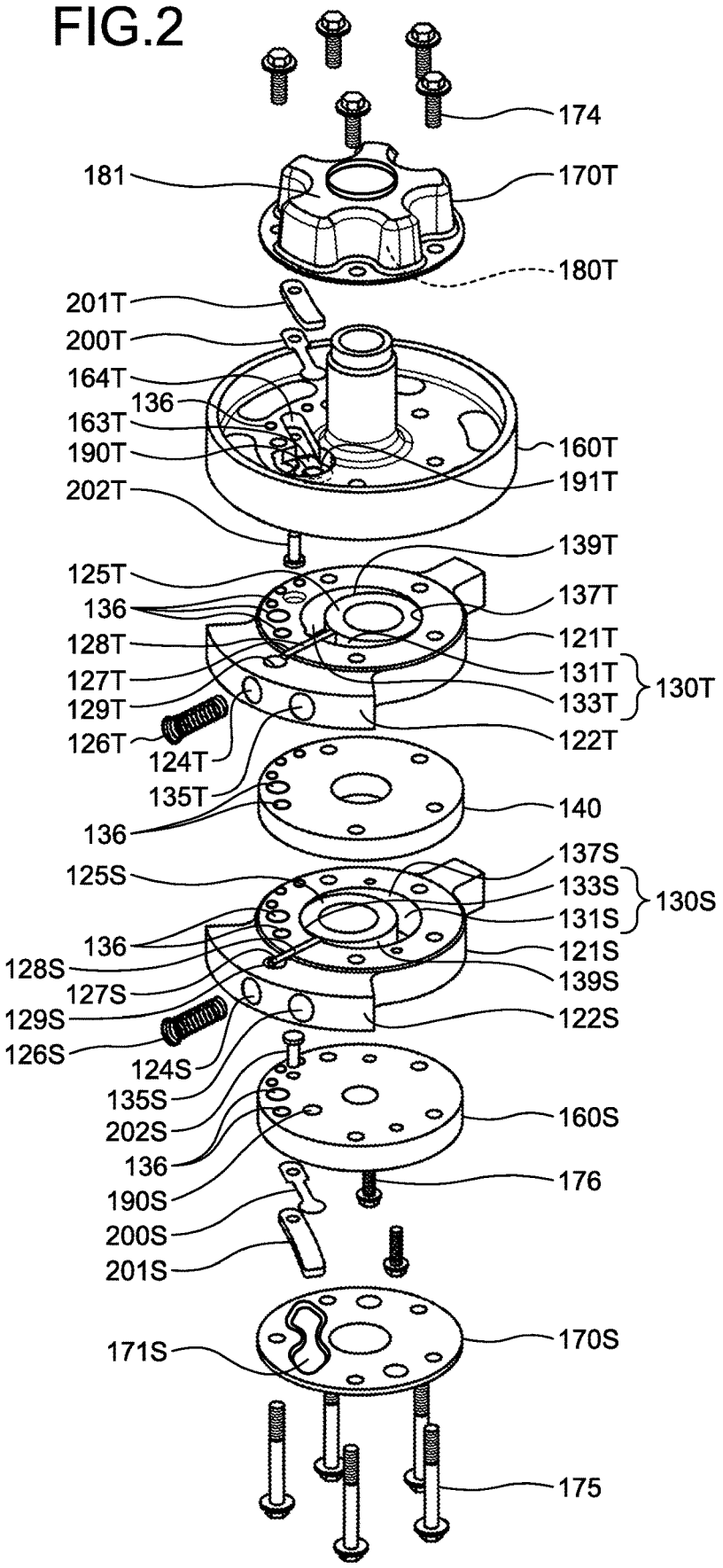
FIG. 2 is an exploded perspective view illustrating a compression unit of the rotary compressor of the embodiment.
Figure 3:
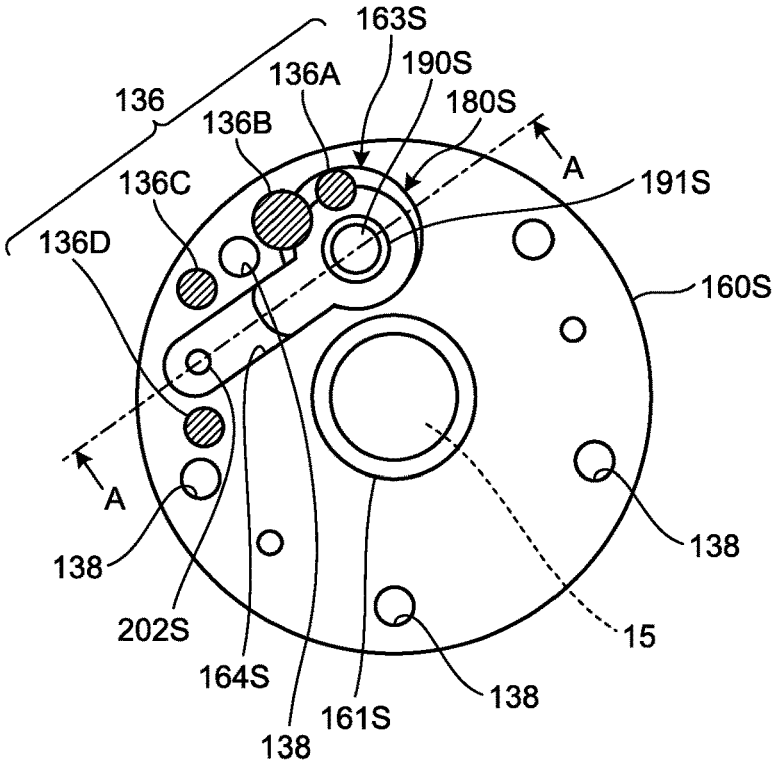
FIG. 3 is a plan view of a lower end plate of the rotary compressor of the embodiment as viewed from below.

FIG. 1 is a longitudinal sectional view illustrating a rotary compressor of an embodiment. FIG. 2 is an exploded perspective view illustrating a compression unit of the rotary compressor of the embodiment. FIG. 3 is a plan view of a lower end plate of the rotary compressor of the embodiment as viewed from below.

As illustrated in FIG. 1, a rotary compressor 1 includes a compression unit 12 arranged at a lower portion in a sealed and vertical cylindrical compressor housing 10, a motor 11 arranged at an upper portion in the compressor housing 10 and configured to drive the compression unit 12 via a rotating shaft 15, and a sealed and vertical cylindrical accumulator 25 fixed to an outer peripheral surface of the compressor housing 10.

The compressor housing 10 includes an upper suction pipe 105 and a lower suction pipe 104 that suck in a refrigerant, and the upper suction pipe 105 and the lower suction pipe 104 are provided at a lower lateral portion of the compressor housing 10. The accumulator 25 is connected to an upper cylinder chamber 130T (see FIG. 2) of an upper cylinder 121T via the upper suction pipe 105 and an accumulator-upper curved pipe 31T as a suction portion, and is connected to a lower cylinder chamber 130S (see FIG. 2) of a lower cylinder 121S via the lower suction pipe 104 and an accumulator-lower curved pipe 31S as a suction portion. In the present embodiment, in the circumferential direction of the compressor housing 10, the positions of the upper suction pipe 105 and the lower suction pipe 104 overlap and are located at the same position.

The motor 11 includes a stator 111 arranged on the outside, and a rotor 112 arranged on the inside. The stator 111 is fixed to the inner peripheral surface of the compressor housing 10 by shrink fitting or welding. The rotor 112 is fixed to the rotating shaft 15 by shrink fitting.

In the rotating shaft 15, a sub-shaft portion 151 below a lower eccentric portion 152S is rotatively supported by a sub-bearing portion 161S provided on a lower end plate 160S, and a main shaft portion 153 above an upper eccentric portion 152T is rotatively supported by a main bearing portion 161T provided on an upper end plate 160T. On the rotating shaft 15, the upper eccentric portion 152T and the lower eccentric portion 152S are provided with a phase difference of 180 degrees from each other, and an upper piston 125T is supported by the upper eccentric portion 152T and a lower piston 125S is supported by the lower eccentric portion 152S. As a result, the rotating shaft 15 is rotatively supported with respect to the entire compression unit 12 and also, by the rotation, makes an outer peripheral surface 139T of the upper piston 125T revolve along an inner peripheral surface 137T of the upper cylinder 121T, and makes an outer peripheral surface 139S of the lower piston 125S revolve along an inner peripheral surface 137S of the lower cylinder 121S.

In the inside of the compressor housing 10, lubricating oil 18 is sealed by an amount that substantially immerses the compression unit 12, in order to ensure lubricity of sliding portions such as the upper cylinder 121T and the upper piston 125T, the lower cylinder 121S and the lower piston 125S, and the like sliding in the compression unit 12 and to seal an upper compression chamber 133T (see FIG. 2) and a lower compression chamber 133S (see FIG. 2). On the lower side of the compressor housing 10, fixed is a mounting leg 310 (see FIG. 1) that latches to a plurality of elastic supporting members (not illustrated) that support the entire rotary compressor 1.

As illustrated in FIG. 1, the compression unit 12 compresses the refrigerant sucked in from the upper suction pipe 105 and the lower suction pipe 104 and discharges the refrigerant from a discharge pipe 107 which will be described later. As illustrated in FIG. 2, the compression unit 12 is made up of, from above, stacking an upper end plate cover 170T having a bulging portion 181 in which a hollow space is formed inside, the upper end plate 160T, the annular upper cylinder 121T, an intermediate partition plate 140, the annular lower cylinder 121S, the lower end plate 160S, and a flat plate-shaped lower end plate cover 170S. The entire compression unit 12 is fixed from above and below by a plurality of through bolts 174 and 175 and auxiliary bolts 176 arranged substantially concentrically.

On the upper cylinder 121T, the cylindrical inner peripheral surface 137T is formed. On the inner side of the inner peripheral surface 137T of the upper cylinder 121T, the upper piston 125T, which has an outer diameter smaller than the inner diameter of the inner peripheral surface 137T of the upper cylinder 121T, is arranged, and between the inner peripheral surface 137T of the upper cylinder 121T and the outer peripheral surface 139T of the upper piston 125T, the upper compression chamber 133T, which sucks, compresses, and discharges the refrigerant, is formed. On the lower cylinder 121S, the cylindrical inner peripheral surface 137S is formed. On the inner side of the inner peripheral surface 137S of the lower cylinder 121S, the lower piston 125S, which has an outer diameter smaller than the inner diameter of the inner peripheral surface 137S of the lower cylinder 121S, is arranged, and between the inner peripheral surface 137S of the lower cylinder 121S and the outer peripheral surface 139S of the lower piston 125S, the lower compression chamber 133S, which sucks, compresses, and discharges the refrigerant, is formed.

As illustrated in FIG. 2, the upper cylinder 121T includes an upper lateral projecting portion 122T projecting from the outer peripheral portion toward the outer peripheral side in the radial direction of the cylindrical inner peripheral surface 137T. On the upper lateral projecting portion 122T, an upper vane groove 128T, which extends radially outward from the upper cylinder chamber 130T, is provided. In the upper vane groove 128T, an upper vane 127T is arranged to be slidable. The lower cylinder 121S includes a lower lateral projecting portion 122S projecting from the outer peripheral portion toward the outer peripheral side in the radial direction of the cylindrical inner peripheral surface 137S. On the lower lateral projecting portion 122S, a lower vane groove 128S, which extends radially outward from the lower cylinder chamber 130S, is provided. In the lower vane groove 128S, a lower vane 127S is arranged to be slidable.

The upper lateral projecting portion 122T is formed extending over a predetermined projecting range, along the circumferential direction of the inner peripheral surface 137T of the upper cylinder 121T. The lower lateral projecting portion 122S is formed extending over a predetermined projecting range, along the circumferential direction of the inner peripheral surface 137S of the lower cylinder 121S. The upper lateral projecting portion 122T and the lower lateral projecting portion 122S are used as chuck holding portions for fixing to a machining jig when machining the upper cylinder 121T and the lower cylinder 121S. As the upper lateral projecting portion 122T and the lower lateral projecting portion 122S are fixed to the machining jig, the upper cylinder 121T and the lower cylinder 121S are positioned at predetermined positions.

On the upper lateral projecting portion 122T, from the outer lateral surface at the position overlapping the upper vane groove 128T, an upper spring hole 124T is provided at a depth not running through the upper cylinder chamber 130T. At the upper spring hole 124T, an upper spring 126T is arranged. On the lower lateral projecting portion 122S, from the outer lateral surface at the position overlapping the lower vane groove 128S, a lower spring hole 124S is provided at a depth not running through the lower cylinder chamber 130S. At the lower spring hole 124S, a lower spring 126S is arranged.

Furthermore, on the upper cylinder 121T, formed is an upper pressure guiding path 129T that guides the compressed refrigerant in the compressor housing 10 by making the outside in the radial direction of the upper vane groove 128T communicate with the inside of the compressor housing 10 via an opening, and that applies a back pressure to the upper vane 127T by the pressure of the refrigerant. On the lower cylinder 121S, formed is a lower pressure guiding path 129S that guides the compressed refrigerant in the compressor housing 10 by making the outside in the radial direction of the lower vane groove 128S communicate with the inside of the compressor housing 10, and that applies a back pressure to the lower vane 127S by the pressure of the refrigerant.

On the upper lateral projecting portion 122T of the upper cylinder 121T, an upper suction hole 135T, to which the upper suction pipe 105 is fitted in, is provided. On the lower lateral projecting portion 122S of the lower cylinder 121S, a lower suction hole 135S, to which the lower suction pipe 104 is fitted in, is provided.

As illustrated in FIG. 2, the upper cylinder chamber 130T is closed by the upper end plate 160T on the upper side, and is closed by the intermediate partition plate 140 on the lower side. The lower cylinder chamber 130S is closed by the intermediate partition plate 140 on the upper side, and is closed by the lower end plate 160S on the lower side.

The upper cylinder chamber 130T is, as the upper vane 127T is pressed by the upper spring 126T and is brought into contact with the outer peripheral surface 139T of the upper piston 125T, sectioned into an upper suction chamber 131T that communicates with the upper suction hole 135T, and into the upper compression chamber 133T that communicates with an upper discharge hole 190T provided on the upper end plate 160T. The lower cylinder chamber 130S is, as the lower vane 127S is pressed by the lower spring 126S and is brought into contact with the outer peripheral surface 139S of the lower piston 125S, sectioned into a lower suction chamber 131S that communicates with the lower suction hole 135S, and into the lower compression chamber 133S that communicates with a lower discharge hole 190S provided on the lower end plate 160S.

Furthermore, the upper discharge hole 190T is provided in the vicinity of the upper vane groove 128T, and the lower discharge hole 190S is provided in the vicinity of the lower vane groove 128S. The refrigerant compressed in the upper compression chamber 133T is discharged passing through the upper discharge hole 190T from the inside of the upper compression chamber 133T. The refrigerant compressed in the lower compression chamber 133S is discharged passing through the lower discharge hole 190S from the inside of the lower compression chamber 133S.

As illustrated in FIG. 2, on the upper end plate 160T, the upper discharge hole 190T, which passes through the upper end plate 160T and communicates with the upper compression chamber 133T of the upper cylinder 121T, is provided. On the outlet side of the upper discharge hole 190T, an upper valve seat 191T is formed around the upper discharge hole 190T. On the upper side (upper end plate cover 170T side) of the upper end plate 160T, an upper discharge-valve accommodating recessed portion 164T, which extends in a groove shape toward the outer periphery of the upper end plate 160T from the position of the upper discharge hole 190T, is formed.

In the inside of the upper discharge-valve accommodating recessed portion 164T, an entire upper discharge valve 200T of a reed valve type and an entire upper discharge valve presser 201T, which regulates an opening degree of the upper discharge valve 200T, are accommodated. In the upper discharge valve 200T, a base end portion is fixed in the upper discharge-valve accommodating recessed portion 164T with an upper rivet 202T, and a distal end portion opens and closes the upper discharge hole 190T. In the upper discharge valve presser 201T, a base end portion is overlapped with the upper discharge valve 200T and fixed in the upper discharge-valve accommodating recessed portion 164T with the upper rivet 202T, and a distal end portion is curved (warped) toward the direction in which the upper discharge valve 200T is opened, and regulates the opening degree of the upper discharge valve 200T. Furthermore, the upper discharge-valve accommodating recessed portion 164T is formed having a width slightly larger than the widths of the upper discharge valve 200T and the upper discharge valve presser 201T, and accommodates the upper discharge valve 200T and the upper discharge valve presser 201T, and also performs positioning of the upper discharge valve 200T and the upper discharge valve presser 201T.

As illustrated in FIG. 3, on the lower end plate 160S, the lower discharge hole 190S, which passes through the lower end plate 160S and communicates with the lower compression chamber 133S of the lower cylinder 121S, is provided. On the outlet side of the lower discharge hole 190S, an annular lower valve seat 191S is formed around the lower discharge hole 190S. The lower valve seat 191S is formed so as to be raised with respect to the bottom surface of a lower discharge-chamber recessed portion 163S which will be described later. On the lower side (lower end plate cover 170S side) of the lower end plate 160S, a lower discharge-valve accommodating recessed portion 164S, which extends in a groove shape toward the outer periphery of the lower end plate 160S from the position of the lower discharge hole 190S, is formed.

In the inside of the lower discharge-valve accommodating recessed portion 164S, an entire lower discharge valve 200S of a reed valve type and an entire lower discharge valve presser 201S, which regulates an opening degree of the lower discharge valve 200S, are accommodated. In the lower discharge valve 200S, a base end portion is fixed in the lower discharge-valve accommodating recessed portion 164S with a lower rivet 202S, and a distal end portion opens and closes the lower discharge hole 190S. In the lower discharge valve presser 201S, a base end portion is overlapped with the lower discharge valve 200S and fixed in the lower discharge-valve accommodating recessed portion 164S with the lower rivet 202S, and a distal end portion is curved (warped) toward the direction in which the lower discharge valve 200S is opened, and regulates the opening degree of the lower discharge valve 200S. Furthermore, the lower discharge-valve accommodating recessed portion 164S is formed having a width slightly larger than the widths of the lower discharge valve 200S and the lower discharge valve presser 201S, and accommodates the lower discharge valve 200S and the lower discharge valve presser 201S, and also performs positioning of the lower discharge valve 200S and the lower discharge valve presser 201S.

In addition, between the upper end plate 160T and the upper end plate cover 170T, which has the bulging portion 181, that are closely fixed to each other, an upper end-plate cover chamber 180T is formed. Between the lower end plate 160S and the flat plate-shaped lower end plate cover 170S that are closely fixed to each other, a lower end-plate cover chamber 180S (see FIG. 3) is formed. A plurality of refrigerant passage holes 136 (shaded portions in FIG. 3), which run through the lower end plate 160S, the lower cylinder 121S, the intermediate partition plate 140, the upper end plate 160T, and the upper cylinder 121T, and which communicates with the lower end-plate cover chamber 180S and the upper end-plate cover chamber 180T, is provided. The refrigerant passage holes 136 will be described later.

As illustrated in FIG. 3, the lower discharge-chamber recessed portion 163S communicates with the lower discharge-valve accommodating recessed portion 164S. The lower discharge-chamber recessed portion 163S is formed to the same depth as the depth of the lower discharge-valve accommodating recessed portion 164S so as to overlap with the lower discharge hole 190S side of the lower discharge-valve accommodating recessed portion 164S. The lower discharge hole 190S side of the lower discharge-valve accommodating recessed portion 164S is accommodated in the lower discharge-chamber recessed portion 163S. The refrigerant passage holes 138A and 136B overlap with at least a part of the lower discharge-chamber recessed portion 163S, and are arranged at positions communicating with the lower discharge-chamber recessed portion 163S.

On the lower surface of the lower end plate 160S (contact surface with the lower end plate cover 170S), in an area other than the area where the lower discharge-chamber recessed portion 163S and the lower discharge-valve accommodating recessed portion 164S are formed, a plurality of bolt holes 138 (FIG. 3), through which the through bolts 175 and the like that couple the compression unit 12 penetrate, is provided. The bolt holes 138 are provided at intervals along the circumferential direction of the lower end plate 160S.

As for an upper discharge-chamber recessed portion 163T and the upper discharge-valve accommodating recessed portion 164T formed on the upper end plate 160T, although detailed depiction is omitted, they are formed in the same shapes as those of the lower discharge-chamber recessed portion 163S and the lower discharge-valve accommodating recessed portion 164S that are formed on the lower end plate 160S. The upper end-plate cover chamber 180T is formed by the dome-shaped bulging portion 181 of the upper end plate cover 170T, the upper discharge-chamber recessed portion 163T, and the upper discharge-valve accommodating recessed portion 164T.

The following describes the flow of refrigerant by the rotation of the rotating shaft 15. In the upper cylinder chamber 130T, by the rotation of the rotating shaft 15, as the upper piston 125T fitted to the upper eccentric portion 152T of the rotating shaft 15 revolves along the inner peripheral surface 137T of the upper cylinder 121T, the upper suction chamber 131T sucks the refrigerant from the upper suction pipe 105 while expanding the volume, the upper compression chamber 133T compresses the refrigerant while reducing the volume, and when the pressure of the compressed refrigerant becomes higher than the pressure of the upper end-plate cover chamber 180T outside of the upper discharge valve 200T, the upper discharge valve 200T is opened and the refrigerant is discharged from the upper compression chamber 133T to the upper end-plate cover chamber 180T. The refrigerant, which is discharged to the upper end-plate cover chamber 180T, is discharged into the compressor housing 10 from an upper end-plate cover discharge hole 172T (see FIG. 1), which is provided on the upper end plate cover 170T.

Furthermore, in the lower cylinder chamber 130S, by the rotation of the rotating shaft 15, as the lower piston 125S, which is fitted to the lower eccentric portion 152S of the rotating shaft 15, revolves along the inner peripheral surface 137S of the lower cylinder 121S, the lower suction chamber 131S sucks the refrigerant from the lower suction pipe 104 while expanding the volume, the lower compression chamber 133S compresses the refrigerant while reducing the volume, and when the pressure of the compressed refrigerant becomes higher than the pressure of the lower end-plate cover chamber 180S outside of the lower discharge valve 200S, the lower discharge valve 200S is opened and the refrigerant is discharged from the lower compression chamber 133S to the lower end-plate cover chamber 180S. The refrigerant, which is discharged to the lower end-plate cover chamber 180S, passes through the refrigerant passage holes 136 and the upper end-plate cover chamber 180T, and is discharged into the compressor housing 10 from the upper end-plate cover discharge hole 172T, which is provided on the upper end plate cover 170T.

The refrigerant, which is discharged into the compressor housing 10, is guided to the upper side of the motor 11 through a cutout (not illustrated), which is provided on the outer periphery of the stator 111 and communicates with the upper and lower portions, a gap (not illustrated) in a winding portion of the stator 111, or a gap 115 (see FIG. 1) between the stator 111 and the rotor 112, and is discharged from the discharge pipe 107 as a discharge portion arranged on the upper portion of the compressor housing 10.

Characteristic Configuration of Rotary Compressor

Figure 4:
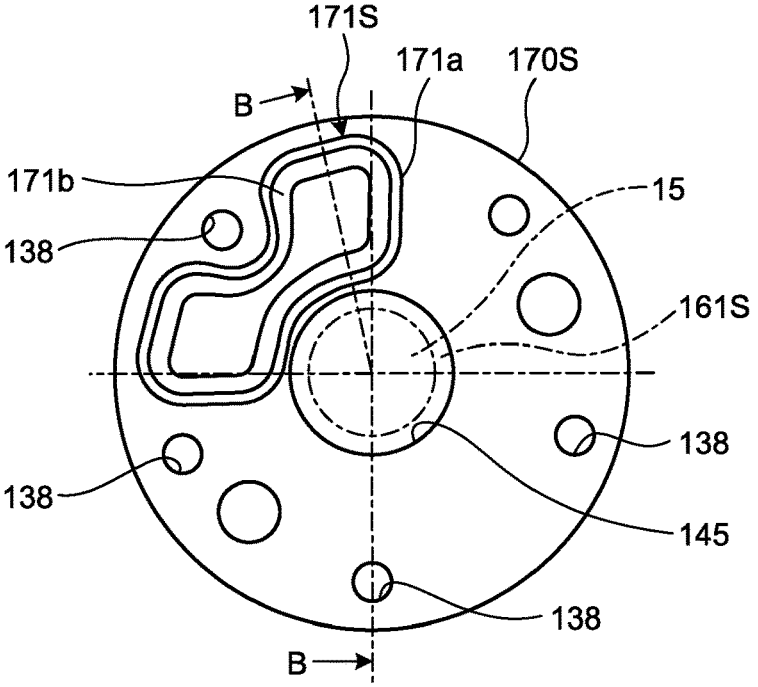
FIG. 4 is a plan view of a lower end plate cover of the rotary compressor of the embodiment as viewed from below.
Figure 5:
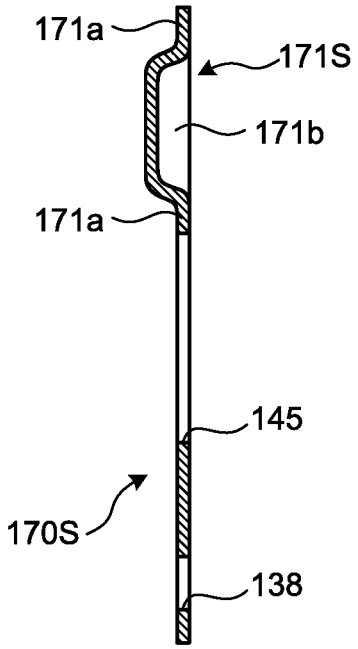
FIG. 5 is a cross-sectional view illustrating the lower end plate cover of the rotary compressor of the embodiment viewed along the B-B line in FIG. 4.
Figure 6:
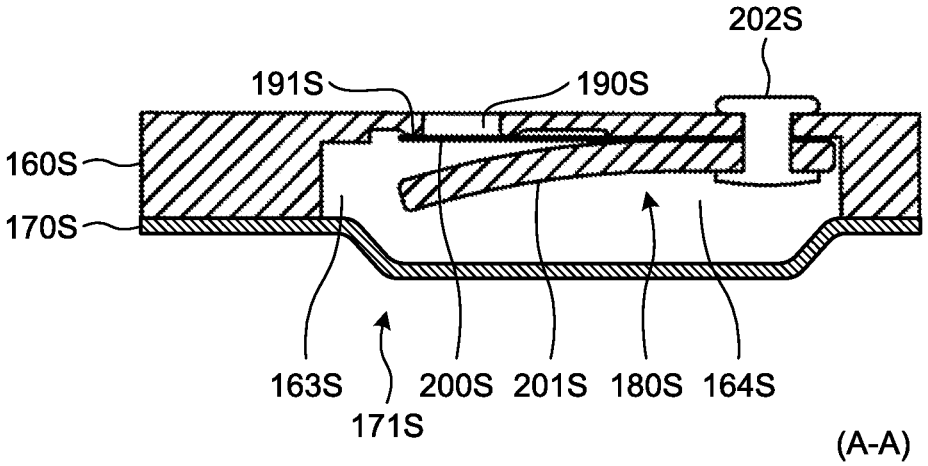
FIG. 6 is a cross-sectional view illustrating a principal portion of the rotary compressor of the embodiment viewed along the A-A line in FIG. 3.
Figure 7:
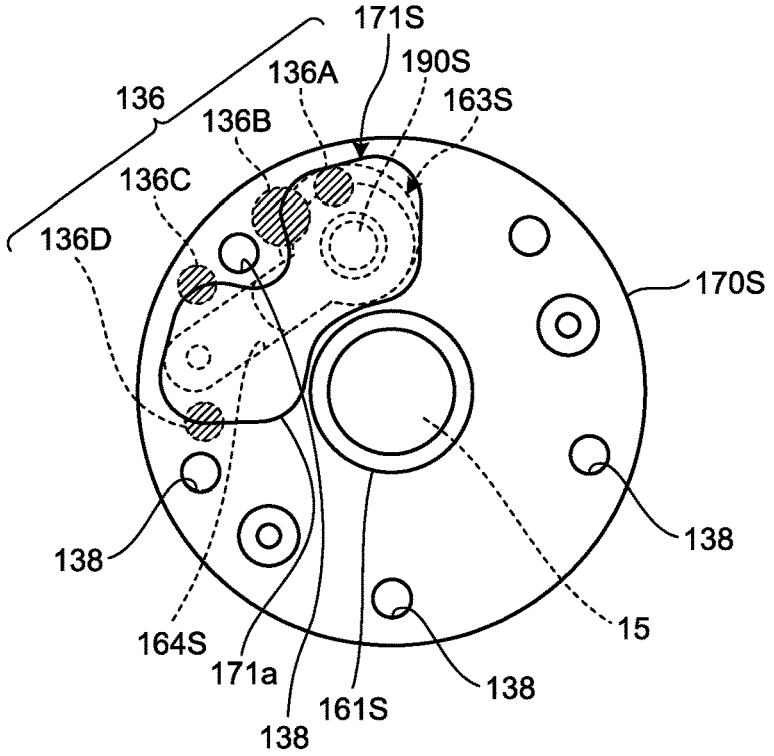
FIG. 7 is a perspective plan view of the lower end plate cover attached to the lower end plate in the rotary compressor of the embodiment as viewed from below.
Figure 8:
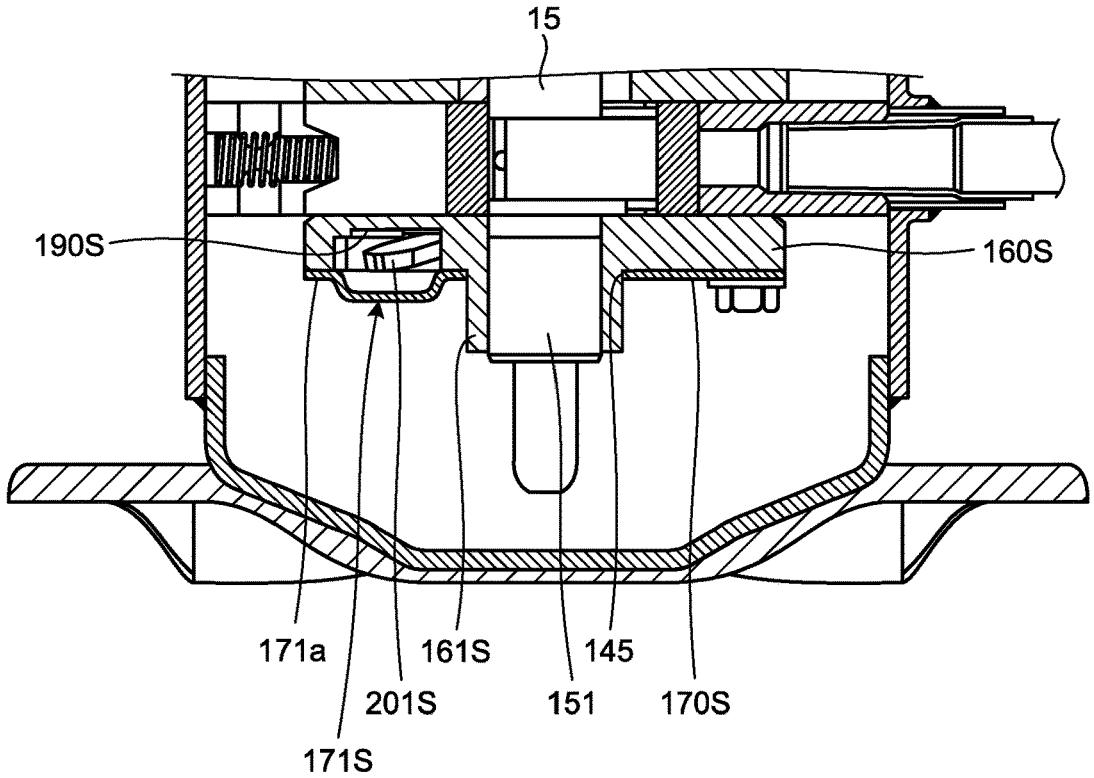
FIG. 8 is a longitudinal sectional view illustrating a principal portion of the rotary compressor of the embodiment.

Next, a characteristic configuration of the rotary compressor 1 of the embodiment will be described. In the present embodiment, the refrigerant passage holes 136 of the lower end plate 160S and a bulging portion 171S of the lower end plate cover 170S are features. FIG. 4 is a plan view of the lower end plate cover 170S of the rotary compressor 1 of the embodiment as viewed from below. FIG. 5 is a cross-sectional view illustrating the lower end plate cover 170S of the rotary compressor 1 of the embodiment viewed along the B-B line in FIG. 4. FIG. 6 is a cross-sectional view illustrating a principal portion of the rotary compressor 1 of the embodiment viewed along the A-A line in FIG. 3. FIG. 7 is a perspective plan view of the lower end plate cover 170S attached to the lower end plate 160S in the rotary compressor of the embodiment as viewed from below. FIG. 8 is a longitudinal sectional view illustrating a principal portion of the rotary compressor 1 of the embodiment.

Configuration of Refrigerant Passage Holes

As illustrated in FIG. 3 and FIG. 7, the lower end plate 160S includes, as the refrigerant passage holes 136 (shaded portions in FIG. 3), a first main refrigerant passage hole 136A and a second main refrigerant passage hole 136B, which are provided on the lower discharge-chamber recessed portion 163S, and includes a first sub-refrigerant passage hole 136C and a second sub-refrigerant passage hole 136D, which are provided between the bolt hole 138 and the lower discharge-valve accommodating recessed portion 164S away from the lower discharge-valve accommodating recessed portion 164S. The first sub-refrigerant passage hole 136C and the second sub-refrigerant passage hole 136D are the refrigerant passage holes 136 supplementally added to the first main refrigerant passage hole 136A and the second main refrigerant passage hole 136B.

The first main refrigerant passage hole 136A and the second main refrigerant passage hole 136B are formed in a circular shape and are arranged adjacent to each other along the outer peripheral surface of the lower end plate 160S. The first main refrigerant passage hole 136A is, in the lower discharge-chamber recessed portion 163S, arranged on the outer peripheral side of the lower end plate 160S with respect to the lower discharge hole 190S and is in contact with the inner peripheral surface of the lower discharge-chamber recessed portion 163S. The second main refrigerant passage hole 136B is arranged so as to overlap partially with the inner peripheral surface of the lower discharge-chamber recessed portion 163S. The second main refrigerant passage hole 136B is formed having a diameter larger than that of the first main refrigerant passage hole 136A, and is arranged on the base end portion side (lower rivet 202S side) of the lower discharge valve 200S relative to the first main refrigerant passage hole 136A. Although the present embodiment includes two of the first main refrigerant passage hole 136A and the second main refrigerant passage hole 136B, the embodiment may be configured with only either one of the first main refrigerant passage hole 136A and the second main refrigerant passage hole 136B.

The first sub-refrigerant passage hole 136C and the second sub-refrigerant passage hole 136D are formed in a circular shape, and are provided between each bolt hole 138 adjacent in the circumferential direction of the lower end plate 160S and the lower discharge-valve accommodating recessed portion 164S away from the lower discharge-valve accommodating recessed portion 164S. In other words, the first sub-refrigerant passage hole 136C and the second sub-refrigerant passage hole 136D are each provided on both sides of the lower discharge-valve accommodating recessed portion 164S in the circumferential direction of the lower end plate 160S. As the first sub-refrigerant passage hole 136C and the second sub-refrigerant passage hole 136D are thus arranged, they are arranged at positions where, without too much deteriorating the mechanical strength of the compression unit 12 along with opening of the sub-refrigerant passage holes 136 on the lower end plate 160S, an appropriate mechanical strength is ensured and where the operation of the compression unit 12 is not affected.

Furthermore, in the present embodiment, the first main refrigerant passage hole 136A, the second main refrigerant passage hole 136B, and the second sub-refrigerant passage hole 136D have an equal hole diameter. Thus, the refrigerant passage holes 136 can be worked by using a common cutting tool, and the productivity of the rotary compressor 1 can be increased. The refrigerant passage holes 136 for which the hole diameter is made equal, are not limited, and by making the hole diameter of at least two out of the first main refrigerant passage hole 136A, the second main refrigerant passage hole 136B, the first sub-refrigerant passage hole 136C, and the second sub-refrigerant passage hole 136D equal, the productivity of the rotary compressor 1 can be increased.

In the present embodiment, the four refrigerant passage holes 136 (the first main refrigerant passage hole 136A, the second main refrigerant passage hole 136B, the first sub-refrigerant passage hole 136C, and the second sub-refrigerant passage hole 136D) are provided, but the number of the refrigerant passage holes 136 is not limited. For example, depending on the air volume and the like of the rotary compressor 1, it may be configured to have only either one of the first sub-refrigerant passage hole 136C and the second sub-refrigerant passage hole 136D, for example. Furthermore, in addition to the first sub-refrigerant passage hole 136C and the second sub-refrigerant passage hole 136D, a third refrigerant passage hole and the like (not illustrated) may further be provided. The refrigerant passage holes 136 are not limited to a circular shape and may be formed in other cross-sectional shapes such as an elliptical shape, for example.

Configuration of Bulging Portion

As illustrated in FIG. 4 and FIG. 5, the lower end plate cover 170S is formed in a flat-plate shape, and includes the bulging portion 171S that bulges downward of the rotary compressor 1. The bulging portion 171S forms the lower end-plate cover chamber 180S. Thus, as illustrated in FIG. 6, the lower end-plate cover chamber 180S is formed by the lower discharge-chamber recessed portion 163S and the lower discharge-valve accommodating recessed portion 164S, which are provided on the lower end plate 160S, and by the bulging portion 171S of the lower end plate cover 170S.

As illustrated in FIG. 4 and FIG. 6, the bulging portion 171S of the lower end plate cover 170S is provided extending over the base end portion side (lower rivet 202S side) of the lower discharge valve presser 201S from a position facing the distal end portion of the lower discharge valve presser 201S (position facing the lower discharge hole 190S). As illustrated in FIG. 4 and FIG. 5, the bulging portion 171S has a sidewall portion 171*b* bulged from a peripheral edge portion 171*a*, and a portion (bottom portion) facing the lower discharge hole 190S, and overlaps with the lower discharge hole 190S in a cross section orthogonal to the shaft direction of the rotating shaft 15.

As illustrated in FIG. 7, at least a part of the bulging portion 171S is formed overlapping with each of the lower discharge-chamber recessed portion 163S and the lower discharge-valve accommodating recessed portion 164S, in a cross section orthogonal to the shaft direction of the rotating shaft 15 (see FIG. 3). Thus, the bulging portion 171S can be formed such that, by expanding the area occupying in the cross section orthogonal to the shaft direction of the rotating shaft 15, the proper volume is ensured and such that the depth in the thickness direction of the lower end plate cover 170S is made shallow. Furthermore, because the bulging portion 171S is formed in a shape including a portion, for which the volume in the cross section orthogonal to the shaft direction of the rotating shaft 15 is changed, that is, what is called a throttle portion, the flow of the refrigerant in the lower end-plate cover chamber 180S can be disturbed, and the flow of the refrigerant can be adjusted as appropriate.

Then, in a cross section orthogonal to the rotating shaft 15, as illustrated in FIG. 7, the bulging portion 171S is formed so as to overlap with at least a part of each of the first main refrigerant passage hole 136A, the second main refrigerant passage hole 136B, the first sub-refrigerant passage hole 136C, and the second sub-refrigerant passage hole 136D. Thus, the first main refrigerant passage hole 136A, the second main refrigerant passage hole 136B, the first sub-refrigerant passage hole 136C, and the second sub-refrigerant passage hole 136D are made to communicate with the lower end-plate cover chamber 180S via the bulging portion 171S.

As just described, by having the first sub-refrigerant passage hole 136C and the second sub-refrigerant passage hole 136D in addition to the first main refrigerant passage hole 136A and the second main refrigerant passage hole 136B, even if the bulging portion 171S is expanded so as to cover the lower discharge-chamber recessed portion 163S and the lower discharge-valve accommodating recessed portion 164S, the refrigerant discharged into the lower end-plate cover chamber 180S can be smoothly discharged via the four refrigerant passage holes 136 (the first main refrigerant passage hole 136A, the second main refrigerant passage hole 136B, the first sub-refrigerant passage hole 136C, and the second sub-refrigerant passage hole 136D) arranged in the periphery of the bulging portion 171S.

Furthermore, as illustrated in FIG. 8, the bulging portion 171S of the lower end plate cover 170S is brought into contact with the lower surface of the lower end plate 160S over the entire peripheral edge portion 171*a* of the bulging portion 171S. As a result, because the bulging portion 171S has no portion extending over the sub-bearing portion 161S, the refrigerant is prevented from leaking from the lower end-plate cover chamber 180S due to variations in the shape of the bulging portion 171S and the shape of the sub-bearing portion 161S, and the airtightness in the bulging portion 171S is enhanced. Note that, in the bulging portion 171S, in the thickness direction of the lower end plate 160S, a portion of the distal end portion of the lower discharge valve presser 201S projecting toward the lower end plate cover 170S side from the lower discharge-chamber recessed portion 163S, may be accommodated.

Furthermore, as illustrated in FIG. 4 and FIG. 5, in the middle of the lower end plate cover 170S, a circular through-hole 145, into which the sub-shaft portion 151 is inserted, is formed. Furthermore, on the lower end plate cover 170S, in an area that is other than the bulging portion 171S and is other than the area facing the lower discharge-chamber recessed portion 163S and the lower discharge-valve accommodating recessed portion 164S of the lower end plate 160S, the bolt holes 138 (FIG. 4) through which the through bolts 175 and the like penetrate is provided.

As in the foregoing, the refrigerant passage holes 136 of the lower end plate 160S in the rotary compressor 1 of the embodiment include the main refrigerant passage holes 136 (the first main refrigerant passage hole 136A and the second main refrigerant passage hole 136B) provided on the lower discharge-chamber recessed portion 163S, and include the sub-refrigerant passage holes 136 (the first sub-refrigerant passage hole 136C and the second sub-refrigerant passage hole 136D) provided between the bolt hole 138 and the lower discharge-valve accommodating recessed portion 164S away from the lower discharge-valve accommodating recessed portion 164S. In a cross section orthogonal to the rotating shaft 15, the bulging portion 171S is formed so as to overlap with at least a part of each of the main refrigerant passage holes 136 (the first main refrigerant passage hole 136A and the second main refrigerant passage hole 136B) and the sub-refrigerant passage holes 136 (the first sub-refrigerant passage hole 136C and the second sub-refrigerant passage hole 136D). Thus, the proper volume of the bulging portion 171S can be ensured and also the refrigerant discharged into the lower end-plate cover chamber 180S can be smoothly discharged via the refrigerant passage holes 136. As a result, according to the embodiment, as the pressure pulsation is suppressed, the efficiency of the rotary compressor 1 can be enhanced and also the vibration of the rotary compressor 1 can be suppressed. Furthermore, as the sub-refrigerant passage holes 136 (the first sub-refrigerant passage hole 136C and the second sub-refrigerant passage hole 136D) are arranged between the bolt hole 138 and the lower discharge-valve accommodating recessed portion 164S away from the lower discharge-valve accommodating recessed portion 164S, without decreasing the mechanical strength of the compression unit 12 along with opening of the sub-refrigerant passage holes 136 on the lower end plate 160S, an appropriate mechanical strength can be ensured.

Thus, according to the embodiment, the enhancement in energy consumption efficiency (coefficient of performance (COP)) in the refrigeration cycle using the rotary compressor 1 and the suppression of vibration of the rotary compressor 1 can be both satisfied appropriately.

Furthermore, at least a part of the bulging portion 171S of the lower end plate cover 170S in the rotary compressor 1 of the embodiment is formed overlapping with each of the lower discharge-valve accommodating recessed portion 164S and the lower discharge-chamber recessed portion 163S, in a cross section orthogonal to the shaft direction of the rotating shaft 15. By expanding the area occupying in the cross section orthogonal to the shaft direction of the rotating shaft 15 in this manner, the bulging portion 171S can be formed such that the proper volume is ensured and such that the depth in the thickness direction of the lower end plate cover 170S is made shallow.

Furthermore, the rotary compressor 1 of the embodiment includes, as the sub-refrigerant passage holes 136, the first sub-refrigerant passage hole 136C and the second sub-refrigerant passage hole 136D provided between each bolt hole 138 adjacent in the circumferential direction of the lower end plate 160S and the lower discharge-valve accommodating recessed portion 164S. As the first sub-refrigerant passage hole 136C and the second sub-refrigerant passage hole 136D are thus arranged, without decreasing the mechanical strength of the compression unit 12 along with opening of the first sub-refrigerant passage hole 136C and the second sub-refrigerant passage hole 136D on the lower end plate 160S, an appropriate mechanical strength can be ensured.

Furthermore, the rotary compressor 1 of the embodiment includes, in a cross section orthogonal to the rotating shaft 15, the first main refrigerant passage hole 136A that is arranged in the lower discharge-chamber recessed portion 163S, and the second main refrigerant passage hole 136B that is arranged overlapping partially with the lower discharge-chamber recessed portion 163S, as the main refrigerant passage holes 136. As a result, the refrigerant, which is discharged from the lower discharge hole 190S, can be discharged smoothly via the first main refrigerant passage hole 136A and the second main refrigerant passage hole 136B.

Furthermore, at least two out of the first main refrigerant passage hole 136A, the second main refrigerant passage hole 136B, the first sub-refrigerant passage hole 136C, and the second sub-refrigerant passage hole 136D in the rotary compressor 1 of the embodiment have the same hole diameter. Thus, the refrigerant passage holes 136 can be worked by using a common cutting tool, and the productivity of the rotary compressor 1 can be increased.

Furthermore, the bulging portion 171S of the lower end plate cover 170S in the rotary compressor 1 of the embodiment is in contact with the lower surface of the lower end plate 160S over the entire peripheral edge portion 171*a* of the bulging portion 171S. As a result, because the bulging portion 171S has no portion extending over the sub-bearing portion 161S, the refrigerant can be prevented from leaking from the lower end-plate cover chamber 180S due to variations in the shape of the bulging portion 171S and the shape of the sub-bearing portion 161S, and the airtightness in the bulging portion 171S can be increased.

As in the foregoing, the embodiment has been described, but the embodiment is not limited by the above-described content. Furthermore, the above-described constituent elements include elements easily achieved by a person skilled in the art, elements being substantially the same as the constituent elements, and elements within the scope of equivalents of the constituent elements. Moreover, the above-described constituent elements may be combined as appropriate. Furthermore, at least one of various omissions, substitutions, and modifications of the constituent elements can be made without departing from the scope of the embodiment.

REFERENCE SIGNS LIST

1 ROTARY COMPRESSOR
10 COMPRESSOR HOUSING
11 MOTOR
12 COMPRESSION UNIT
15 ROTATING SHAFT
104 LOWER SUCTION PIPE (SUCTION PORTION)
105 UPPER SUCTION PIPE (SUCTION PORTION)
107 DISCHARGE PIPE (DISCHARGE PORTION)
121T UPPER CYLINDER
121S LOWER CYLINDER
125T UPPER PISTON
125S LOWER PISTON
127T UPPER VANE
127S LOWER VANE
128T UPPER VANE GROOVE
128S LOWER VANE GROOVE
130T UPPER CYLINDER CHAMBER
130S LOWER CYLINDER CHAMBER
131T UPPER SUCTION CHAMBER
131S LOWER SUCTION CHAMBER
133T UPPER COMPRESSION CHAMBER
133S LOWER COMPRESSION CHAMBER
136 REFRIGERANT PASSAGE HOLE
136A FIRST MAIN REFRIGERANT PASSAGE HOLE
136B SECOND MAIN REFRIGERANT PASSAGE HOLE
136C FIRST SUB-REFRIGERANT PASSAGE HOLE
136D SECOND SUB-REFRIGERANT PASSAGE HOLE
138 BOLT HOLE
140 INTERMEDIATE PARTITION PLATE
160T UPPER END PLATE
160S LOWER END PLATE
163T UPPER DISCHARGE-CHAMBER RECESSED PORTION
163S LOWER DISCHARGE-CHAMBER RECESSED PORTION
164T UPPER DISCHARGE-VALVE ACCOMMODATING RECESSED PORTION
164S LOWER DISCHARGE-VALVE ACCOMMODATING RECESSED PORTION
170S LOWER END PLATE COVER
171S BULGING PORTION
174, 175 THROUGH BOLT
176 AUXILIARY BOLT
180T UPPER END-PLATE COVER CHAMBER
180S LOWER END-PLATE COVER CHAMBER
190T UPPER DISCHARGE HOLE
190S LOWER DISCHARGE HOLE
200T UPPER DISCHARGE VALVE
200S LOWER DISCHARGE VALVE

The invention claimed is:

1. A rotary compressor, comprising:

a sealed and vertical cylindrical compressor housing provided with a refrigerant discharge portion at an upper portion and a refrigerant suction portion at a lower portion;

a compression unit arranged at the lower portion of the compressor housing and configured to compress the refrigerant that is sucked from the suction portion and to discharge the refrigerant from the discharge portion; and a motor arranged at the upper portion of the compressor housing and configured to drive the compression unit, wherein the compression unit includes an annular upper cylinder and an annular lower cylinder, an upper end plate closing an upper side of the upper cylinder and a lower end plate closing a lower side of the lower cylinder, an intermediate partition plate arranged between the upper cylinder and the lower cylinder and closing a lower side of the upper cylinder and an upper side of the lower cylinder, a rotating shaft supported by a main bearing portion provided on the upper end plate and by a sub-bearing portion provided on the lower end plate, and rotated by the motor, an upper eccentric portion and a lower eccentric portion provided on the rotating shaft with a phase difference of 180° from each other, an upper piston fitted in the upper eccentric portion and configured to revolve along an inner peripheral surface of the upper cylinder and form an upper cylinder chamber in the upper cylinder, a lower piston fitted in the lower eccentric portion and configured to revolve along an inner peripheral surface of the lower cylinder and form a lower cylinder chamber in the lower cylinder, an upper vane projecting into the upper cylinder chamber from an upper vane groove provided on the upper cylinder and brought into contact with the upper piston so as to section the upper cylinder chamber into an upper suction chamber and an upper compression chamber, a lower vane projecting into the lower cylinder chamber from a lower vane groove provided on the lower cylinder and brought into contact with the lower piston so as to section the lower cylinder chamber into a lower suction chamber and a lower compression chamber, an upper end plate cover covering the upper end plate, forming an upper end-plate cover chamber between the upper end plate and the upper end plate cover, and having an upper end-plate cover discharge hole communicating with the upper end-plate cover chamber and an inside of the compressor housing, a lower end plate cover covering the lower end plate and forming a lower end-plate cover chamber between the lower end plate and the lower end plate cover, an upper discharge hole provided on the upper end plate and communicating with the upper compression chamber and the upper end-plate cover chamber, a lower discharge hole provided on the lower end plate and communicating with the lower compression chamber and the lower end-plate cover chamber, and a plurality of refrigerant passage holes running through the lower end plate, the lower cylinder, the intermediate partition plate, the upper end plate, and the upper cylinder and communicating with the lower end-plate cover chamber and the upper end-plate cover chamber, the lower end plate includes a plurality of bolt holes that is provided along a circumferential direction of the lower end plate and through which bolts that couple the compression unit penetrate, a lower discharge valve of a reed valve type that is configured to open and close the lower discharge hole, a lower discharge-valve accommodating recessed portion that extends in a groove shape up to a portion between the bolt holes adjacent in the circumferential direction from the lower discharge hole and into which the lower discharge valve is accommodated, and a lower discharge-chamber recessed portion formed so as to overlap with the lower discharge hole side of the lower discharge-valve accommodating recessed portion, the lower end plate cover is formed in a flat-plate shape and is provided with a bulging portion having a portion facing the lower discharge hole, the lower end-plate cover chamber is formed by the lower discharge-valve accommodating recessed portion, the lower discharge-chamber recessed portion, and the bulging portion, the refrigerant passage holes include a main refrigerant passage hole provided on the lower discharge-chamber recessed portion, and a sub-refrigerant passage hole provided between the bolt hole and the lower discharge-valve accommodating recessed portion away from the lower discharge-valve accommodating recessed portion, and the bulging portion is, in a cross section orthogonal to the rotating shaft, formed so as to have no portion extending over the sub-bearing portion, and formed so as to overlap with at least a part of each of the main refrigerant passage hole and the sub-refrigerant passage hole.

2. The rotary compressor according to claim 1, wherein at least a part of the bulging portion of the lower end plate cover is formed so as to overlap with each of the lower discharge-valve accommodating recessed portion and the lower discharge-chamber recessed portion, in a cross section orthogonal to a shaft direction of the rotating shaft.

3. The rotary compressor according to claim 1, wherein the sub-refrigerant passage hole includes a first sub-refrigerant passage hole and a second sub-refrigerant passage hole provided between each of the bolt holes adjacent in the circumferential direction and the lower discharge-valve accommodating recessed portion.

4. The rotary compressor according to claim 3, wherein the main refrigerant passage hole includes a first main refrigerant passage hole arranged in the lower discharge-chamber recessed portion, and includes a second main refrigerant passage hole arranged so as to overlap partially with the lower discharge-chamber recessed portion, in a cross section orthogonal to the rotating shaft.

5. The rotary compressor according to claim 4, wherein at least two out of the first main refrigerant passage hole, the second main refrigerant passage hole, the first sub-refrigerant passage hole, and the second sub-refrigerant passage hole have a same hole diameter.

6. The rotary compressor according to claim 1, wherein the bulging portion of the lower end plate cover is in contact with a lower surface of the lower end plate over an entire peripheral edge portion of the bulging portion.

* * * * *